US006877252B2

(12) United States Patent
Wilkinson

(10) Patent No.: US 6,877,252 B2
(45) Date of Patent: Apr. 12, 2005

(54) SLIP-ON SHOE

(76) Inventor: William T. Wilkinson, P.O. Box 73, Salem, NJ (US) 08079

( * ) Notice: Subject to any disclaimer, the term of this patent is extended or adjusted under 35 U.S.C. 154(b) by 0 days.

(21) Appl. No.: 10/125,219

(22) Filed: Apr. 18, 2002

(65) Prior Publication Data

US 2002/0166257 A1 Nov. 14, 2002

Related U.S. Application Data

(60) Provisional application No. 60/284,829, filed on Apr. 19, 2001.

(51) Int. Cl.[7] ..... A43B 7/14

(52) U.S. Cl. ..... 36/11.5; 36/138; 36/105; 36/106

(58) Field of Search ..... 36/114, 11.5, 138, 36/3, 71, 105, 106, 8.1

(56) References Cited

U.S. PATENT DOCUMENTS

| | | | | | |
|---|---|---|---|---|---|
| D31,422 | S | * | 8/1899 | Kingsland | |
| 726,778 | A | * | 4/1903 | Smith | 36/8.1 |
| 1,803,554 | A | * | 5/1931 | Knilans | 36/114 |
| 1,973,085 | A | * | 9/1934 | Liberman | 36/71 |
| 2,090,573 | A | * | 8/1937 | Allesandro | 36/71 |
| 2,099,418 | A | * | 11/1937 | Bradley et al. | 36/11.5 |
| 2,734,286 | A | * | 2/1956 | Anson | 36/141 |
| 2,981,010 | A | * | 4/1961 | Aaskov | 36/11.5 |
| 3,057,086 | A | | 10/1962 | Rigsby | 36/2.5 |
| 4,034,431 | A | | 7/1977 | Fukuoka | 12/142 |
| 4,294,023 | A | | 10/1981 | Banford | 36/11.5 |
| 4,425,721 | A | | 1/1984 | Spronken | 36/11.5 |
| 4,535,554 | A | | 8/1985 | De Obaldia B. | 36/113 |
| 4,608,769 | A | | 9/1986 | Sturlaugson | 36/68 |
| 4,649,939 | A | * | 3/1987 | Curtis | 602/27 |
| 4,794,705 | A | * | 1/1989 | Sanders | 36/72 B |
| 4,807,372 | A | * | 2/1989 | McCall | 36/135 |
| 4,856,209 | A | * | 8/1989 | Kenyon | 36/114 |
| 5,054,216 | A | | 10/1991 | Lin | 36/138 |
| 5,090,140 | A | | 2/1992 | Sessa | 36/138 |
| 5,282,327 | A | | 2/1994 | Ogle | 36/138 |
| 5,689,901 | A | * | 11/1997 | Bell et al. | 36/7.6 |
| 5,787,608 | A | | 8/1998 | Greenawalt | 36/11.5 |

OTHER PUBLICATIONS

International Search Report dated Apr. 19, 2002, to application No. PCT/US02/12537 (corresponding PCT application).

* cited by examiner

*Primary Examiner*—M. D. Patterson
(74) *Attorney, Agent, or Firm*—RatnerPrestia

(57) ABSTRACT

A shoe having a rubberized sole, a heel section having a heel support, an at least partially covered toe section, and a generally open midsection extending from approximately the wearer's toe/instep joint to the front of the wearer's ankle. In some embodiments, the shoe may comprise waterproof materials or water resistant materials. The midsection may comprise a side rail that rises above the sole between the toe section and the heel section. The shoe may further comprise a strap anchored to one side of the shoe and adapted to wrap around the wearer's foot to a securing member on the other side of the shoe to secure the wearer's foot in the shoe.

28 Claims, 2 Drawing Sheets

SLIP-ON SHOE

CROSS-REFERENCE TO RELATED APPLICATIONS

This invention claims priority based upon U.S. Provisional Patent Application Ser. No. 60/284,829 filed Apr. 19, 2001, incorporated herein by reference.

TECHNICAL FIELD

This invention relates to shoes, and more particularly to slip-on shoes ideal for wearing in warm weather.

BACKGROUND OF THE INVENTION

Sneakers and sandals are both popular types of shoes, and both, but in particular the sandal, are frequently worn during warm weather. Each type of footwear has certain unique and desirable features with respect to the other, but each also has certain drawbacks. For example, sneakers tend to be relatively heavy, especially as compared to a sandal, and can be hot to wear, which may lead to sweaty feet and odors. Sneakers are also more difficult and take more time to get on and off than a sandal. Sneakers tend to cramp or restrict the forefoot and toes, as well as the midsection and top tendon of the foot, rather than being open like a sandal.

Sandals, however, despite their advantages, tend to offer little support for the foot and little padding to add comfort. Sandals, because of their openness, are prone to getting stones, sand, debris, and the like under the foot. Sandals also offer less protection for the foot than a sneaker.

Thus, there is a need in the art for a hybrid shoe for warm weather that overcomes the respective disadvantages of the sneaker and the sandal, while incorporating the respective desirable features of each.

There is also a need in the art for shoes of any type, not just warm weather shoes, that are true slip-on/slip-off shoes. Many shoes that purport to be slip-on shoes still require assistance from the wearer in the form of sliding a shoehorn or finger behind the user's heel, or, in the absence of using a finger or some type of shoehorn, the back of the shoe buckles under the heel of the user's foot, requiring the user to then insert a finger to correct the bucked portion of the shoe. Slipping off the same shoes may require stepping on the back heel of the shoe while forcefully pulling the foot out, or using a hand to pry the user's foot out of the shoe. The need to use such force is often frustrating to the wearer, and sometimes damaging to the shoe. It is therefore desirable to provide a shoe with features that allow it to slip on and off easier than the so-called "slip-on" shoes known in the art.

SUMMARY OF THE INVENTION

In one aspect of this invention, there is provided a shoe having a rubberized sole; a heel section having a heel support; an at least partially covered toe section; and a generally open midsection extending from approximately the wearer's toe/instep joint to a front of the wearer's ankle. In some embodiments, the shoe may comprise waterproof materials or water resistant materials. The midsection may comprise a side rail that rises above the sole between the toe section and the heel section.

The shoe may further comprise a strap anchored to one side of the shoe and adapted to wrap around a wearer's foot to a securing member on the other side of the shoe for securing the wearer's foot in the shoe with the strap. The strap may be padded. The strap may be adapted for storage behind the heel support when not wrapped around the wearer's foot. The heel support may have a rear-facing surface comprising a loop for securing the strap when the strap is not wrapped around the wearer's foot. The strap comprises an inward facing side that contacts the wearer's foot, and an outward-facing side that faces away from the wearer's foot. The inward facing side may comprise microloops of a microhook/microloop fastener system and the outward-facing side may comprise microhooks. The securing member may comprise a loop through which the strap may be looped and folded back upon itself to be tightened around the wearer's foot. Where the microhook/microloop strap is adapted to store behind the heel support when not wrapped around the wearer's foot, the heel support may comprise microloops adapted for receiving the microhooks of the strap.

In some embodiments, the heel support may have a top section that is angled-backward. The top section may be rolled and padded. The heel support top section may comprise an arced cross-sectional periphery from a point inside the shoe to a topmost point of the heel support. The heel support may have a top section that is angled-backward relative to the bottommost surface of the sole at an angle of greater than or equal to 90°. The toe section may comprise a slope from toe to heel, wherein the toe section further comprises an upper rear edge that is angled-upward relative to the toe section slope.

The toe section may be bulbous. The toe section may be covered with a breathable material. The generally open midsection may have an open top and open or covered sides. The covered sides may comprise an extension of the breathable material from the toe section to the heel section. The toe section may comprise a covering material and a front bumper that is relatively harder than the covering material. The bumper may comprise a portion of the sole that extends upwardly from the sole. The bumper may extend over top of the wearer's toes. The bumper may extend alongside the wearer's toes.

Another aspect of the invention comprises a shoe having a heel support with a top section that is angled-backward to allow a wearer's foot to slip into the shoe without the heel support buckling and without the wearer using a shoehorn or a finger to facilitate slipping the shoe on. The heel support top section may be rolled and may comprise an arced cross-sectional periphery from a point inside the shoe to a topmost point of the heel support. The heel support top section may be padded and rolled. The heel support may comprise a top section that is angled-backward relative to the bottommost surface of the sole at an angle of greater than or equal to 90°.

Still another aspect of the invention comprises any shoe with a toe section that comprises a slope, wherein the toe section further comprises an upper rear edge that is angled-upward relative to the toe section slope. The upper rear edge may be padded and rolled.

A preferred embodiment comprises a shoe comprising a rubberized sole; a heel section having a heel support with a top section that is angled-backward; and a bulbous toe section at least partially covered with a breathable material and having a front bumper comprising a portion of the sole that extends upwardly from the sole to cover overtop and alongside at least a portion of the wearer's toes. The shoe also comprises a generally open midsection extending from approximately the wearer's toe/instep joint to a front of the wearer's ankle; and a padded strap anchored to one side of the shoe and adapted to wrap around a wearer's foot to a securing member on the other side of the shoe for securing the wearer's foot in the shoe with the strap.

DETAILED DESCRIPTION OF INVENTION

The invention will next be illustrated with reference to the figures wherein the same numbers indicate similar elements in all figures. The figures are intended to be illustrative rather than limiting and are included herewith to facilitate the explanation of the apparatus of the present invention.

Figure 1A:
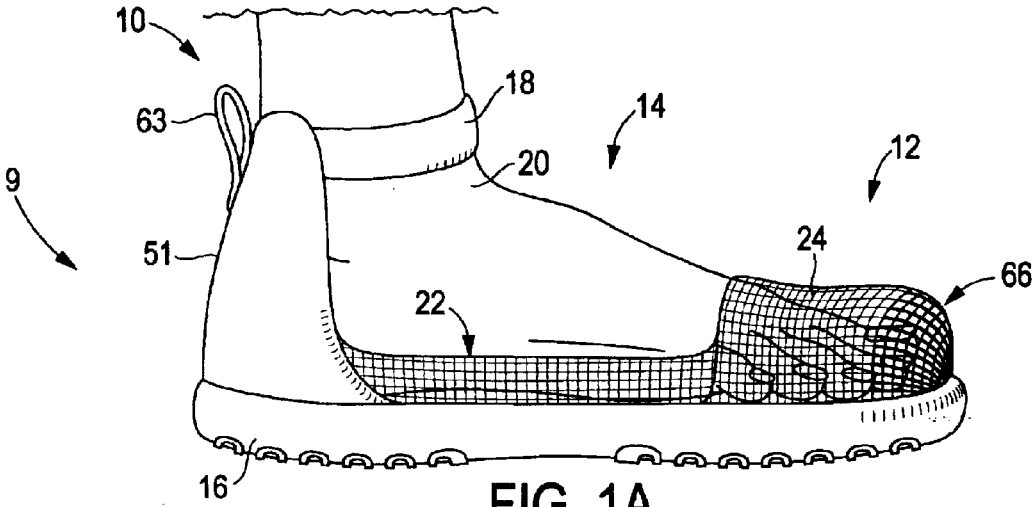
FIG. 1A is a side view illustration of an exemplary shoe of the present invention having side strips along the mid-section.

An exemplary slip-on shoe 9 of the present invention is shown in FIG. 1A and has a number of features. Shoes in accordance with this invention may have at least one of the features shown in FIGS. 1A–6 or all such features. The shoe can be worn with or without socks, but is adapted to be worn without socks. The shoe generally has a heel section 10, a toe section 12, a midsection 14, and a sole 16. Sole 16 preferably comprises any rubberized sneaker-type sole material known in the art for providing superior traction, support and impact absorption. The term "rubberized" herein includes any synthetic or natural rubber-like material that is known in the art for use in sneaker soles, or has material properties similar to such materials and suited for providing traction, support, and impact absorption. Sole 16 may be similar to the sole of any running or walking shoe, and is preferably relatively light and tough with non-slip features. Non-slip features are particularly desirable for the soles of warm-weather embodiments of this invention, where the shoes may be worn near water, such as on boats or near pools.

Heel section 10 also provides a sneaker-type heel support 51 that is preferably padded for comfort. Strap 18, for example a hook and loop type fastener such as a Velcro® fastener, is adapted to be strapped over the front of a wearer's ankle 20 for quick fastening and unfastening, and is preferably padded for comfort.

Figure 1B:
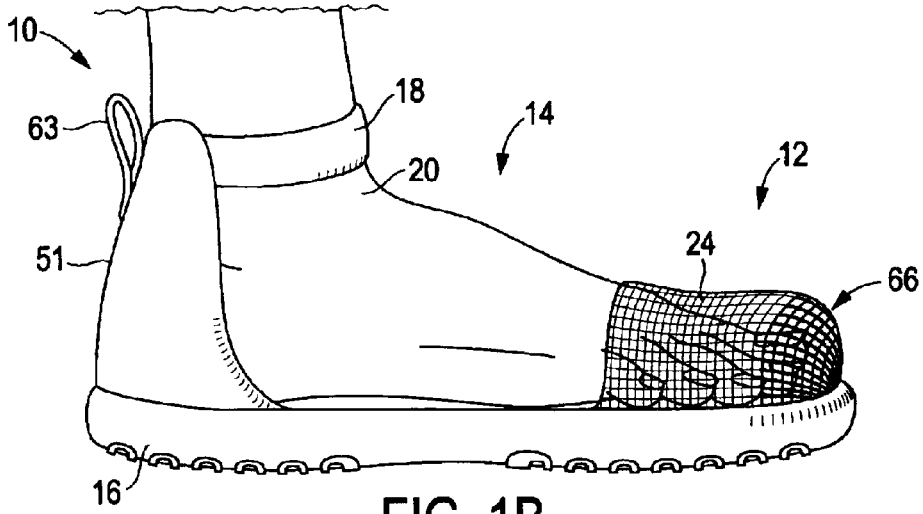
FIG. 1B is a side view illustration of another exemplary shoe of the present invention having open sides along the midsection.

Midsection 14, where a sneaker would normally have laces, is generally open on the top and sides for ease of slipping the shoe on and off and for cooler feet. Midsection 14 may have a relatively low side rail 22, however, that protrudes upwardly from sole 16 as shown in FIG. 1A. In another embodiment, as shown in FIG. 1B, midsection 14 may have open sides with no side rail.

Toe section 12 is preferably wide and bulbous like a sandal, and may be open with merely a strap (not shown), such as a strap comprising Velcro® hook and loop fastener, over the toe section. Toe section 12 is preferably partially or fully covered, however, with a toe covering 24 that preferably comprises a breathable, mesh type, elastic material that is soft and comfortable to the touch, such as for example spandex. This allows the forefoot and toes to be cool, and also allows flexibility, for comfort. In a preferred embodiment, the toe section may extend only as far rearward as the toe/instep joint 202 as shown on foot 200 shown in FIG. 3. In other embodiments, however, the toe section may extend further or less far rearward.

The invention combines desirable features from both sneakers and sandals to produce a superior, warm/hot weather, sneaker-type shoe that has many advantages. For example, the slip-on shoe of the present invention is more lightweight, easier and quicker to get on/off, and easier to fit than a sneaker. It provides better support for the foot than a sandal, and is comfortable and more padded than a sandal, but is cooler to wear than a sneaker, so that the wearer's feet breathe more and sweat less than in a sneaker, making the shoe less prone to odor. The shoe does not cramp or restrict the forefoot and toes or the midsection of the top tendon of the foot, like a sneaker does. Because of the covered toe and side rail, the shoe is less prone to getting stones, sand, debris, and the like under the foot than a sandal, and also gives more protection to the foot than a sandal. The closed toe section 12 and supported heel section 10 allow for a shoe that can have more style and color than a sandal, while still being cheaper, less expensive, and easier to wash and dry than a sneaker. The added support in heel section 10 and toe covering 24 on the toe section 12 make the shoe more versatile than a sandal. The sneaker-like sole 16 provides more cushion underneath the foot than a sandal.

Figure 2:
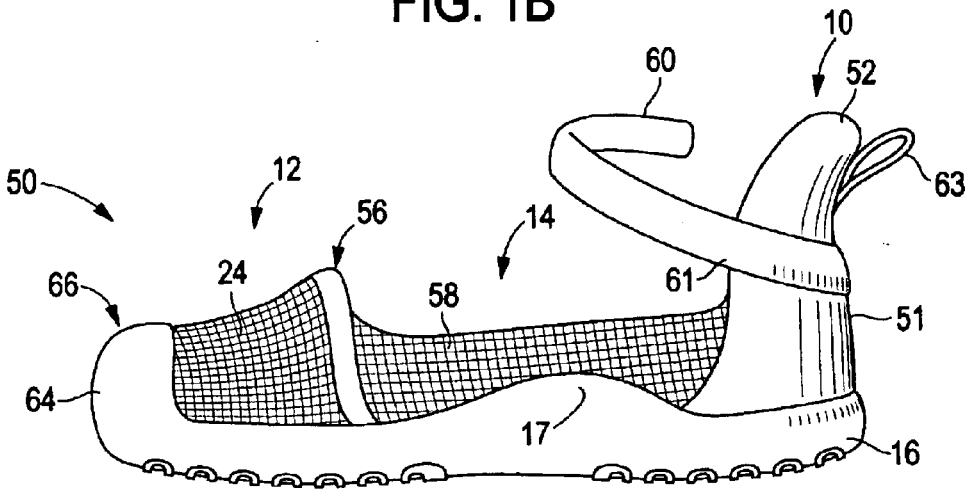
FIG. 2 is a side view illustration of another exemplary shoe of the present invention.

Another embodiment of the present invention is shown in FIG. 2. Shoe 50 also has a supported heel section 10, generally open midsection 14, and a toe section 12 having a toe covering 24 which preferably comprises a breathable material that extends toward the heel only as far as the joint between the toes and the foot on the wearer's foot. Sole 16 may have an arch support 17. Shoe 50 may be designed to be particularly easy to slip on and off. This ease of slipping on and off is enhanced by a number of features, of which a shoe of this invention may have at least one, or all.

Figure 3:
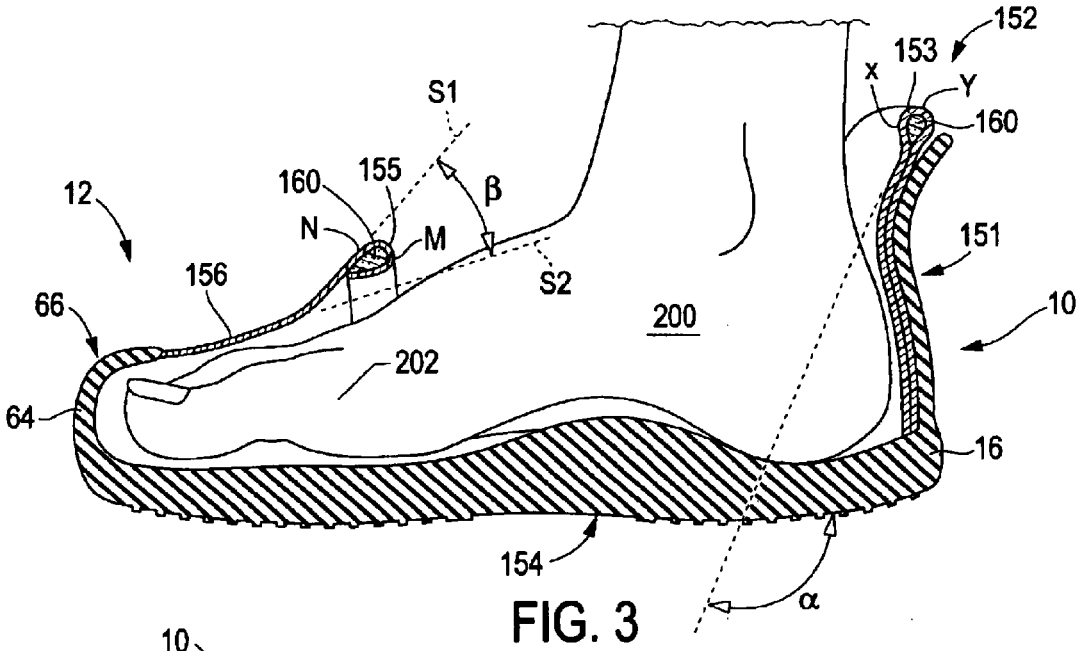
FIG. 3 is a cross-sectional illustration of an exemplary shoe of the present invention having an angled-backward heel support top portion and an angled-upward toe section upper rear edge.
Figure 4:
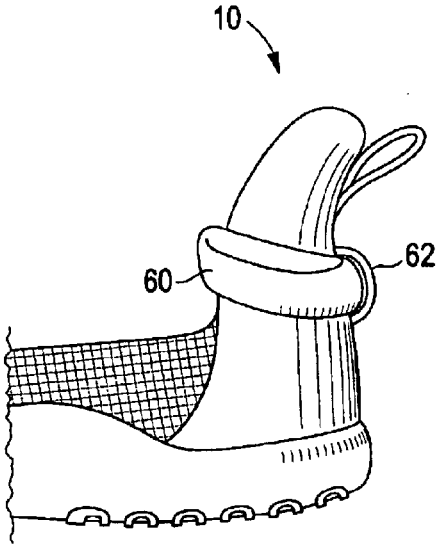
FIG. 4 is a side view illustration of the heel portion of the shoe of FIG. 2, with the strap stored behind the heel.

Referring now to FIG. 3, there is shown a cross-sectional illustration of an embodiment wherein heel section 10 features a heel support 151 having a top portion 152 that is angled backward and may additionally be rolled and padded for comfort. Angled-backward top portion 152 allows the wearer's heel to slip into the shoe easily, without buckling the top portion 152, and essentially provides a built-in shoe-horn for the shoe. Upper rear edge 156 of toe section 12 may also be angled upward, as well as padded and rolled. The angled-backward top portion 152 of heel support 151 and angled-upward toe section upper rear edge 156 allow the wearer to slip his or her foot into and out of the shoe without the top portion or upper rear edge buckling and without having to use his or her fingers or a shoe horn.

"Buckling" refers to the top portion or upper rear edge of the shoe folding under or otherwise deforming as the wearer's foot is inserted into the shoe to a degree that the wearer must then take a remedial measure to fix the buckled portion of the shoe. The remedial measure may include inserting a finger or a shoehorn around the periphery of the foot to unfold the folded-under portion, grabbing the edge of the material and pulling it out, or wiggling the feet repeatedly in the shoe to work the fold out. To further minimize buckling, the angled-backward and angled-upward sections may be relatively more rigid than the surrounding material, so that, although these sections may flex as the foot is inserted into the shoe, they do not fold under. The angled configuration and other buckling-minimizing features of top portion 152 and upper rear edge 156 are not limited only to warm-weather shoes or sneaker/sandal hybrids of this invention. These features may also be provided on any type of shoe to make the shoe easy to slip on and off without the top portion or upper rear edge buckling, and without the wearer having to use his or her fingers or a shoehorn.

Angled-backward top portion 152 and angled upward upper rear edge 156 of toe section 12 in FIG. 3 are padded and rolled. By "rolled" it is meant that these sections have a convex periphery, which may be arced or semicircular in cross-section. For example, top portion 152 of heel section 10 has a convex periphery 153 between point X inside the shoe and a topmost point Y. Toe section upper front edge 156 has a convex, arced, semicircular periphery 155 between point M on an inner surface of the toe section to point N on an upper surface of the toe section. Although the convex peripheries are shown in FIG. 3 as being arced and semicircular, the convex periphery is not limited to a arc, nor is the arc limited to a semicircular geometry, but rather any geometry may be used that provides comfort for the heel and helps the wearer's foot 200 slip into the shoe. By "padded", it is meant that top portion 152 and angled upward upper rear edge 156 of toe section 12 comprise padding 160 at least underneath the rolled periphery 153 and 155. By "angled backward," it is meant that top portion 152 creates an angle $\alpha$ of greater than or equal to 90° with the bottommost surface 154 of sole 16. By "angled upward" it is meant that the slope S1 of toe section upper front edge 156 creates an angle $\beta$ greater than 0° relative to slope S2 of the remainder of toe section 12. The overall geometry of top portion 152 may mimic shoehorn geometry known in the art.

As shown in FIG. 2, toe section 12 may optionally connect to heel section 10 with side strips 58. Toe section 12 and heel section 10 may also be completely separate, with open sides in midsection 14, similar to the embodiment shown in FIG. 1B. Where side strips 58 are present, they are relatively low to the sole, to allow for a cool foot. Side strips 58 may comprise a mesh or webbed lattice material that is cool and airy.

Figure 6:
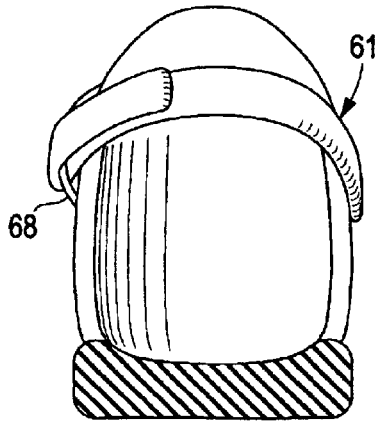
FIG. 6 is a partial cross section illustration of an exemplary shoe of this invention showing an exemplary strap and securing member.

Shoe 50 is shown with a strap 60 on heel section 10 that can be put around the wearer's ankle to secure the foot in the shoe to enable more rigorous activities such as but not limited to: hiking, fast walking, running, jumping, kicking, swimming, wading, or driving. Although shown attached to the heel section, the strap may be anchored anywhere on the shoe, so long as the path of the strap falls somewhere between the front of the wearer's ankle to the rear of the wearer's toes so that the strap secures the foot in the shoe. Strap 60 is preferably padded for comfort. The strap is anchored to the shoe at an anchoring region 61 on one side of the shoe, and then extends across the wearer's foot to a securing member 68 on the opposite side of the shoe, as shown in FIG. 6. As shown in FIG. 6, securing member 68 may be a loop through which strap 60 loops around and folds back on itself. Strap 60 may comprise a microhook and microloop fastening system, such as a Velcro® system. For a microhook/microloop system, the relatively softer microloops are preferably positioned on the side of the strap adjacent the wearer's foot and the relatively less comfortable microhooks are positioned on the side of the strap facing away from the wearer's foot. In this way, the strap will stick to itself when wrapped around securing member 68 and doubled back on itself. Securing member 68 may comprise other means for securing a strap, such as for example a buckle, In the embodiment shown in FIG. 4, strap 60 may be stored behind heel section 10 when not in use. Strap 60 tucks behind heel section 10, such as through one or more loops 62, which secure the strap in place. In the alternative, where strap 60 comprises, for example, the microhook portion of a hook and loop fastening system on the side of the strap facing away from the wearer's foot, microloops may be positioned in one or more locations to enable the strap to stick to the heel section 10. Although most comfortable with microloops facing the wearer's foot, the positioning of the microloops and microhooks may be reversed, if desired. Heel section 10 may also have a hang loop 63, as shown in FIGS. 1A–2, so that the shoe can be easily hung on a hook.

Figure 5:
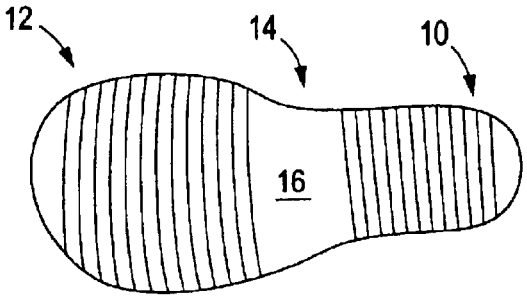
FIG. 5 is a bottom view illustration of an exemplary, bulbous sole of the present invention.

As shown in FIG. 5, toe section 12 of sole 16 is preferably bulbous to allow for the forefoot and toes to spread out naturally when bearing weight. Covering 24 over toe section 12, as shown in FIGS. 1A–2 is also preferably made of a flexible, stretchable material to further allow the forefoot and toes to spread out. The material may be meshed, webbed or latticed to be cool and airy.

Because toe section 10 is preferably made of a thinner, flexible material, the toe may be more vulnerable to stubbing than in a regular sneaker. The front portion 64 of toe section 10 may therefore comprise a protective bumper, such as a rolled up portion of sole 16 shown in FIG. 2, to protect the toes from "stubbing." Front bumper portion 64 helps to protect the toes from hitting against hard objects. Also or instead, front and/or upper portion 66 of toe section 12 may be made of a harder material than the rest of the toe covering 24, to protect the front of the toes, as shown in FIGS. 1A and 1B. This harder, protective section may extend over top of the tips of the toes, for example. In one embodiment, shown in FIG. 3, bumper portion 64 may comprise an extension of sole 16 that is molded to extend to upper portion 66 and wrap around the front and sides of the toes. Such a wraparound bumper protects the sides and a portion of the top of the toes, and provides a readily identifiable design feature that is recognizable by consumers. Molding the sole and bumper together may be a relatively inexpensive way of providing the desired protection, and may provide a clean, sharp look aesthetically. The toe section may be highlighted with a different color or style than the rest of the shoe for emphasis. In another embodiment, the bumper may comprise a material that is separate and distinct from the sole rather than being an extension of the sole.

In any of the embodiments shown and described, the materials of the shoe are preferably waterproof or water resistant to allow for wearing during all weather condition, and washable for easy washing and drying, unlike leather sandals, for example, that may tend to dry and crack. Any of the sections, of the shoe, such as toe section 12, sole 16, heel section 10, front bumper portion 64, and ankle strap 60 may be colored or patterned to create a distinct style. The shoe is typically constructed of lightweight, flexible materials, so that it can be easily carried and stored. The inside of the shoe is preferably padded, so that there is more arch support, and more comfort than a sandal.

Those skilled in the art having the benefit of the teachings of the present invention as set forth, can effect numerous modifications. These modifications are to be construed as being encompassed within the scope of the present invention as set forth in the appended claims. In particular, certain embodiments and types of materials having certain properties are discussed herein as being preferred or desirable, but the invention is not limited to such embodiments or materials. The shoes of this invention may be constructed of any materials known in the art. Furthermore, although exemplary shoes are described herein having a number of features, shoes of the present invention may have any one, a select plurality, of features in any combination, or all of the features described herein.

What is claimed:

1. A shoe adapted to receive a foot of a wearer, the wearer's foot having toes, an instep, a toe/instep joint adjoining the toes with the instep, and an ankle, the shoe comprising:

a rubberized sole;

a heel section having a heel support;

an at least partially covered toe section comprising a breathable material; and a generally open midsection extending from approximately the wearer's toe/instep joint to a front of the wearer's ankle, the midsection comprising a side rail that rises above the sole between the toe section and the heel section, and an uncovered top portion above the side rails.

2. The shoe of claim 1 further comprising a strap anchored to one side of the shoe and adapted to wrap around a wearer's foot to a securing member on the other side of the shoe for securing the wearer's foot in the shoe with the strap.

3. The shoe of claim 2 wherein the strap is padded.

4. The shoe of claim 1 wherein the shoe comprises waterproof materials or water resistant materials.

5. The shoe of claim 1 wherein the heel support has a top section that is angled-backward.

6. The shoe of claim 5 wherein the top section is rolled and padded.

7. The shoe of claim 6 wherein the heel support top section comprises an arced cross-sectional periphery from a point inside the shoe to a topmost point of the heel support.

8. The shoe of claim 5 wherein the heel support has a top section that is angled-backward relative to a bottommost surface of the sole at an angle of greater than or equal to 90°.

9. The shoe of claim 1 wherein the toe section is bulbous.

10. The shoe of claim 1 wherein the side rail comprises an extension of the breathable material from the toe section to the heel section.

11. The shoe of claim 1 wherein the toe section has a covering material and a front bumper that is relatively harder than the covering material.

12. The shoe of claim 11 wherein the bumper comprises a portion of the sole that extends upwardly from the sole.

13. The shoe of claim 12 wherein the bumper extends overtop the wearer's toes.

14. The shoe of claim 13 wherein the bumper extends alongside the wearer's toes.

15. The shoe of claim 2 further comprising means for storing the strap behind the heel support when the strap is not wrapped around the wearer's foot.

16. The shoe of claim 15 wherein the heel support has a rear-facing surface comprising a loop for securing the strap when the strap is not wrapped around the wearer's foot.

17. The shoe of claim 2 wherein the strap comprises a microhook/microloop fastener system, wherein the securing member comprises a loop through which the strap may be looped and folded back upon itself to be tightened around the wearer's foot.

18. The shoe of claim 17 wherein the strap is adapted to store behind the heel support when not wrapped around the wearer's foot, the heel support comprising a microhook/microloop fastener element-adapted for receiving a portion of the microhook/microloop fastener system of the strap.

19. The shoe of claim 1 wherein the toe section comprises a slope from toe to heel, the toe section further comprising an upper rear edge that is angled-upward relative to the toe section slope.

20. A shoe comprising:

a heel support having a top section that is angled-backward to allow a wearer's foot to slip into the shoe without the heel support buckling and without the wearer using a shoehorn or a finger to facilitate slipping the shoe on, and a toe section having an integral upper rear edge that is rolled upward, the rolled rear edge comprising a continuous member that extends from a point on an inner surface of the toe section in a convex periphery to a point on an upper surface of the toe section.

21. The shoe of claim 20 wherein the heel support top section is rolled and comprises an arced cross-sectional periphery from a point inside the shoe to a topmost point of the heel support.

22. The shoe of claim 21 wherein the heel support top section is padded and rolled.

23. The shoe of claim 22 wherein the heel support has a top section that is angled-backward from a bottommost surface of the sole at an angle of greater than or equal to 90°.

24. The shoe of claim 20 wherein the toe section comprises a slope, and the upper rear edge is angled-upward relative to the toe section slope.

25. The shoe of claim 20 wherein the upper rear edge is padded.

26. The shoe of claim 20, wherein the toe section upper rear edge comprises a material that is soft and comfortable to the touch.

27. A shoe for a wearer having a foot with toes, an instep, a toe/instep joint adjoining the toes with the instep, and an ankle, the shoe comprising:

a rubberized sole;

a heel section having a heel support with a top section that is angled-backward to allow a wearer's foot to slip into the shoe without the heel support buckling and without the wearer using a shoehorn or a finger to facilitate slipping the shoe on;

a bulbous toe section at least partially covered with a breathable material and having a front bumper comprising a portion of the sole that extends upwardly from the sole to cover overtop and alongside at least a portion of the wearer's toes, the toe section having an upper rear edge that is rolled upward and comprises a continuous member that extends from a point on an inner surface of the toe section in a convex periphery to a point on an upper surface of the toe section;

a generally open midsection comprising at least an uncovered top portion extending from approximately the wearer's toe/instep joint to a front of the wearer's ankle; and a padded strap anchored to one side of the shoe and adapted to wrap around a wearer's foot to a securing member on the other side of the shoe for securing the wearer's foot in the shoe with the strap.

28. The shoe of claim 27 wherein the generally open midsection has an open top and open sides.

* * * * *